US010550551B2

(12) United States Patent
Hoeptner, III

(10) Patent No.: US 10,550,551 B2
(45) Date of Patent: Feb. 4, 2020

(54) VALVE ASSEMBLY FOR USE WITH MULTIPLE LIQUID LINES

(71) Applicant: Herbert W. Hoeptner, III, Gilroy, CA (US)

(72) Inventor: Herbert W. Hoeptner, III, Gilroy, CA (US)

( * ) Notice: Subject to any disclaimer, the term of this patent is extended or adjusted under 35 U.S.C. 154(b) by 0 days.

(21) Appl. No.: 15/936,931

(22) Filed: Mar. 27, 2018

(65) Prior Publication Data

US 2018/0282981 A1 Oct. 4, 2018

Related U.S. Application Data

(60) Provisional application No. 62/601,677, filed on Mar. 28, 2017.

(51) Int. Cl.

| | |
|---|---|
| ***E03B 9/14*** | (2006.01) |
| ***E03B 7/12*** | (2006.01) |
| ***E03B 9/04*** | (2006.01) |
| ***E03B 9/20*** | (2006.01) |

(52) U.S. Cl.

CPC ..... *E03B 9/14* (2013.01); *E03B 7/12* (2013.01); *E03B 9/04* (2013.01); *E03B 9/20* (2013.01)

(58) Field of Classification Search

CPC ..... E03B 7/12; E03B 9/04; E03B 9/20; F15B 13/0803; Y10T 137/87249; Y10T 137/538

See application file for complete search history.

(56) References Cited

U.S. PATENT DOCUMENTS

| | | | | |
|---|---|---|---|---|
| 1,354,064 | A * | 9/1920 | Pratt | E03B 9/20 239/28 |
| 1,894,573 | A * | 1/1933 | Sexton | E03B 9/20 239/29.3 |
| 2,207,458 | A * | 7/1940 | Deal | E03B 9/20 119/74 |
| 3,076,473 | A * | 2/1963 | Wadey | F15C 1/02 137/270 |
| 4,854,339 | A | 8/1989 | Hoeptner, III | |
| 5,033,500 | A | 7/1991 | Hoeptner, III | |
| 5,553,637 | A * | 9/1996 | Hoeptner, III | E03B 7/12 137/281 |
| 5,709,247 | A * | 1/1998 | Hutton | F15B 13/0814 137/597 |
| 5,787,928 | A * | 8/1998 | Allen | B05B 5/1625 137/240 |

(Continued)

*Primary Examiner* — Mary E McManmon
*Assistant Examiner* — Kevin R Barss
(74) *Attorney, Agent, or Firm* — Intellectual Innovations Legal Advisors

(57) ABSTRACT

A supply assembly for use with a hydrant comprising a first supply valve adapted for coupling to a first supply line of the hydrant and a second supply valve adapted for coupling to a second supply line of the hydrant. A housing contains a first drain valve and a second drain valve. The first supply valve is coupled to the first drain valve for permitting water to be drained from the first supply line when a first outlet of the hydrant is off, and the second supply valve is coupled to the second drain valve for permitting water to be drained from the second supply line when a second outlet of the hydrant is off. The first supply valve is above the second supply valve to permit radially compact nesting of the first supply valve and the second supply valve. Related assemblies, valves and methods are provided.

23 Claims, 11 Drawing Sheets

(56) References Cited

U.S. PATENT DOCUMENTS

| | | | | |
|---|---|---|---|---|
| 5,832,956 | A * | 11/1998 | Nimberger | F16K 11/22 137/597 |
| 6,003,780 | A * | 12/1999 | Gurries, II | E03B 9/14 137/281 |
| 6,047,723 | A | 4/2000 | Hoeptner, III | |
| 6,085,776 | A | 7/2000 | Hoeptner, III | |
| 6,427,716 | B1 | 8/2002 | Hoeptner, III | |
| 6,857,446 | B1 | 2/2005 | Hoeptner, III | |
| 7,040,342 | B1 * | 5/2006 | Stehling | E03B 9/02 137/327 |
| 2008/0289711 | A1 * | 11/2008 | Shultz | F16K 27/003 137/861 |
| 2012/0073685 | A1 * | 3/2012 | Morgan | F16K 27/0236 137/613 |
| 2014/0109973 | A1 * | 4/2014 | Neumeister | F16K 41/10 137/1 |

* cited by examiner

VALVE ASSEMBLY FOR USE WITH MULTIPLE LIQUID LINES

CROSS REFERENCE TO RELATED APPLICATION

This application claims priority to U.S. provisional patent application Ser. No. 62/601,677 filed Mar. 28, 2017, the entire content of which is incorporated herein by this reference.

FIELD OF THE INVENTION

This invention relates generally to drain assemblies for self-operating hydrants, such as drinking fountains, and more particularly to drain assemblies for multiple self-operating hydrants.

BACKGROUND OF THE INVENTION

Drain assemblies for use with hydrants have been provided. See for example U.S. Pat. Nos. 5,553,637 and 6,085,776. There is a need, however, for an improved drain assembly that is more compact, more easily manufacturable and more easily scalable to one or more hydrants.

DETAILED DESCRIPTION OF THE INVENTION

Figure 1:
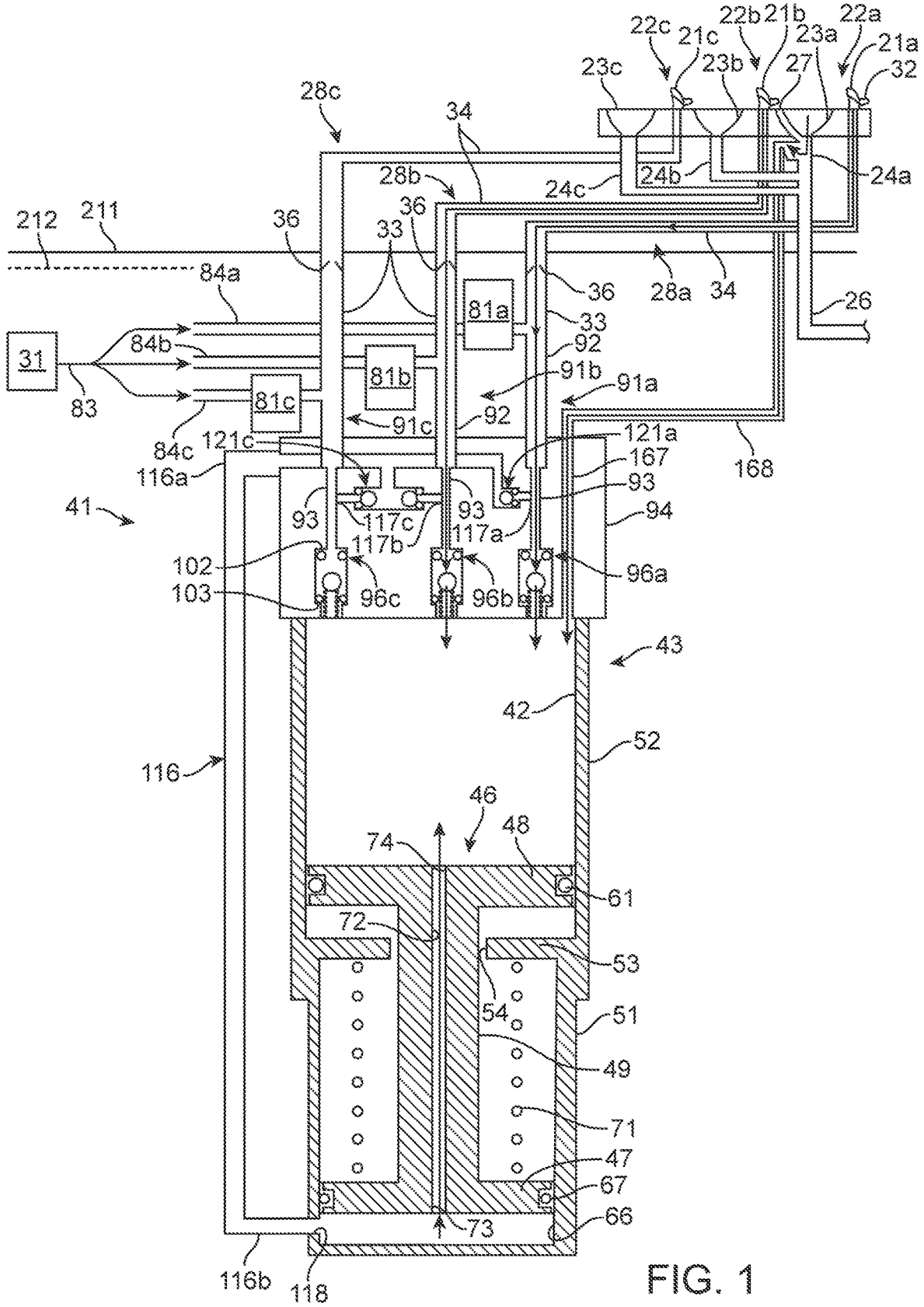
FIG. 1 is a schematic view of a drain assembly of the present invention for use with one or more hydrants, in an OFF configuration.

A drain assembly is provided that can be used with one or more hydrants, which can be referred to as a single hydrant with a plurality of outlets. The hydrant and outlets can be of any suitable type, for example bubblers of one or more drinking fountains. One or more supply valves can be provided for supplying water or another liquid to the one or more hydrants or outlets by a respective one or more supply lines. The drain assembly can be provided with a reservoir for draining the one or more supply lines when the respective one or more supply valves are in an OFF position. The drain assembly can include a piston, movable between first and second positions, for emptying or draining the accumulated liquid in the reservoir, for example when the one or more supply valves are activated. The piston can be moved to empty or drain the accumulated liquid in the reservoir under the force of the supply water from the one or more activated supply valves. In some embodiments, the drain assembly can be easily scaled during manufacture to operate with any number of hydrants or outlets. In some embodiments, the drain assembly can have a compact configuration, for example a relatively small diameter or transverse dimension, for facilitating installation of the drain assembly.

In some embodiments, the drain assembly can be used with a one or more drinking bubblers, each having a supply water inlet. One or more control or supply valves can be provided, each having a water inlet and a water outlet. A drain water reservoir and a piston movable therein between first and second positions can be provided for varying the volume of the drain reservoir. A water delivery line can be connectable to each of the one or more valves and to a first side of the piston. In some methods of operation, when one or more of the valves are operated to an ON position, they permit water to flow from a suitable pressurized water supply to the supply water inlet of the respective one or more bubblers and to the first side of the piston. The piston, under the force of the pressurized supply water moves from its first position to its second position, causing any drain water in the reservoir to exit the drain reservoir. In some methods of operation, when all of the one or more valves are operated to an OFF position, any supply water remaining between the valves and the respective one or more bubblers drains into the reservoir. The drain water reservoir can be formed by the piston moving from its second position to its first position, for example under the force of a spring.

In some embodiments, the drain assembly can include one more drain valves coupled between the respective one or more control or supply valves and the drain reservoir. In some methods of operation, when all of the one or more control valves are in an OFF position, any supply water remaining between the control valves and the respective one or more bubblers drains through the respective one or more drain valves into the drain reservoir. When any combination of the one or more control valves are in an ON position, the supply water that passes through a control valve causes the respective drain valve to move to a closed position so as to prevent pressurized supply water from the control valve to flow into the reservoir. The supply water from the ON control valve flows to the respective bubbler.

In some embodiments, one or more additional valves are provided in the drain assembly and connected in series with respective one or more control valves. In some methods of operation, when any combination of the control valves are in the ON position, water flows from the one or more ON control valves to the respective bubblers and the one or more additional valves prevent supply water from the one or more ON control valves from flowing to the respective bubblers of the one or more OFF control valves.

In some embodiments, the drain assembly can include one more drain valves coupled between the respective one or more control or supply valves and the drain reservoir. In some methods of operation, the piston can be moved from its first position to its second position to empty or drain accumulated drain water in the reservoir. The one or more drain valves inhibit the accumulated water from reentering or flowing into the respective supply lines, which may contaminate the supply lines.

In some embodiments, the one or more control valves communicate respectively with one or more drain valves, which permit water in the respective supply lines to drain to a reservoir when the respective control valve is in an OFF position.

In some embodiments, the drain assembly can be installed underground, for example below the frost line.

Figure 2:
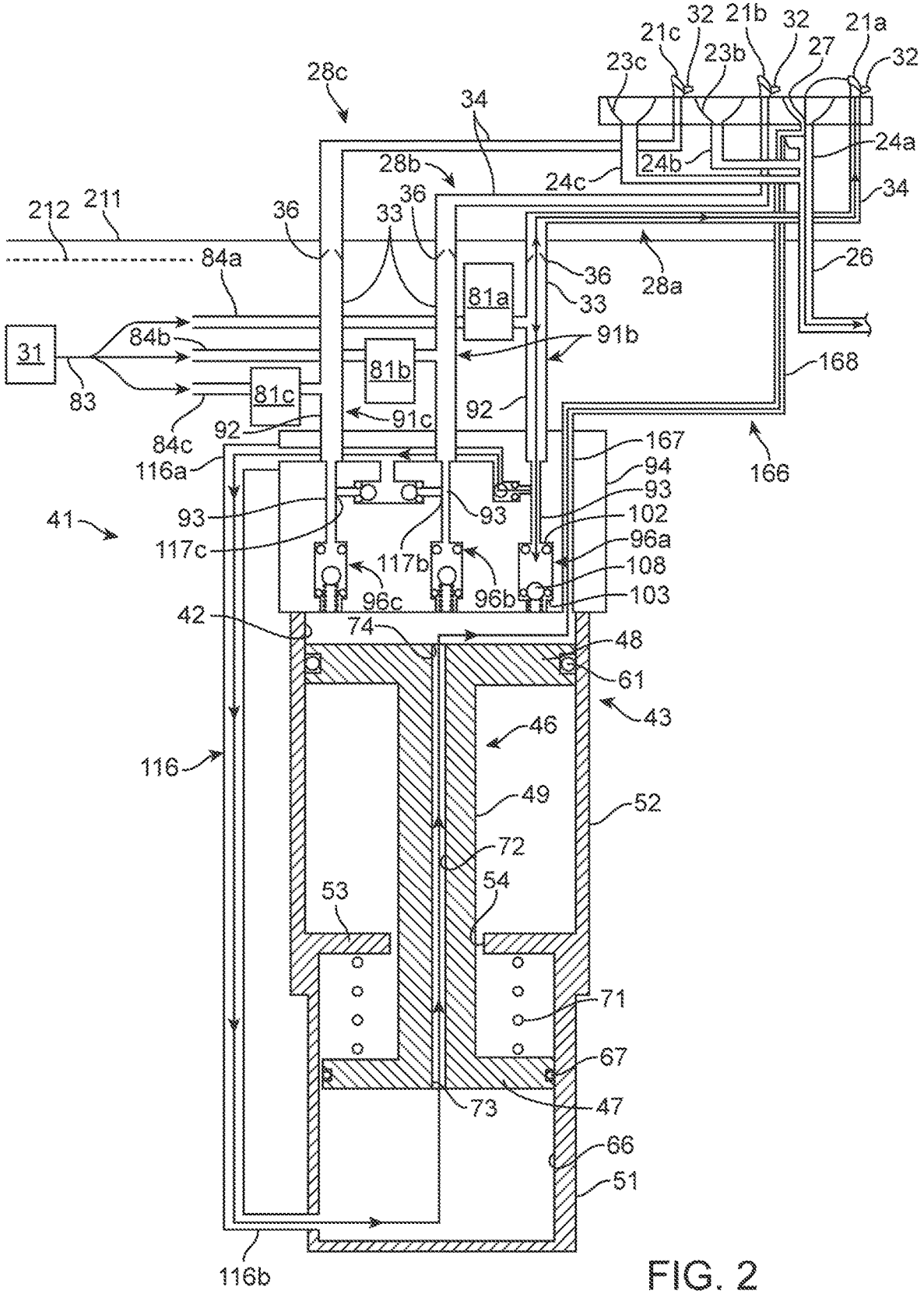
FIG. 2 is a schematic view of the drain assembly of FIG. 1, in a first ON configuration.
Figure 3:
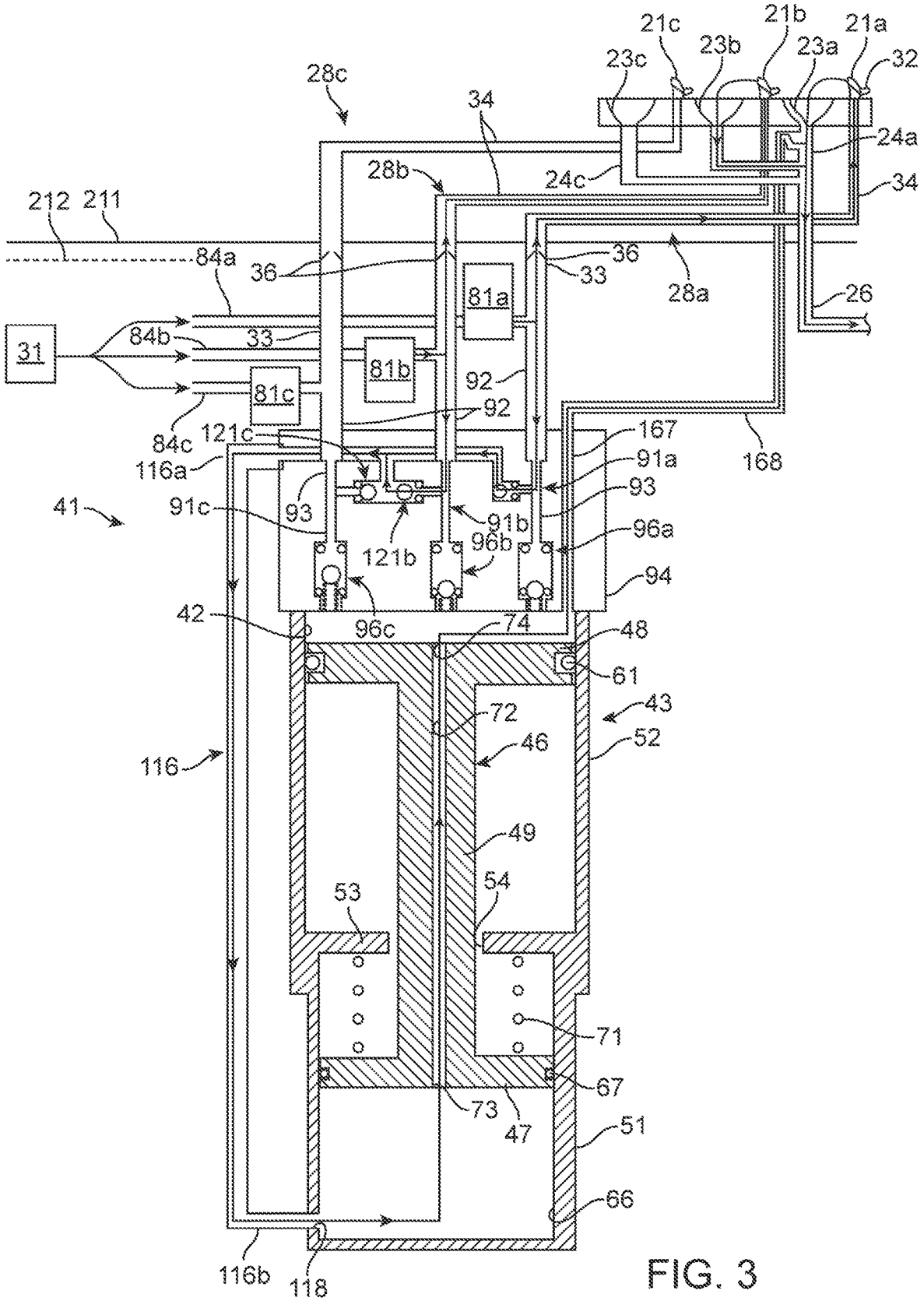
FIG. 3 is a schematic view of the drain assembly of FIG. 1, in a second ON configuration.

The drain assembly of the invention can be used with one or more hydrants 21, which can be referred to as a single hydrant with a plurality of outlets. The hydrant 21 can be of any suitable type, for example bubblers of one or more drinking fountains. Any number of hydrants 21 can be provided. Three hydrants 21 are shown in FIGS. 1-3 as part of three drinking fountains 22, more specifically first fountain 22*a*, second fountain 22*b* and third fountain 22*c*. Each fountain 22 can include a bubbler 21 and a basin 23, for example first bubbler 22*a* and first basin 23*a*, second bubbler 21*b* and second basin 23*b* and third bubbler 21*c* and third basin 23*c*. A drain 24 can extend from each basin 23, for example first drain 24*a*, second drain 24*b* and third drain 24*c*, for emptying the contents of the respective basin 23. The drains 24 can connect or join to a common drain 26, which can be provided with a suitable airgap 27 for facilitating the operation of the drains 24, 26. A water supply line 28 of any suitable type can be fluidly coupled to each bubbler 21 for providing pressurized water to the drinking fountain 22 from any suitable water source 31. Each of the supply lines 28 can be referred to as a liquid-carrying line, a liquid line, a fluid-carrying line or a fluid line. In this regard, for example, a first supply line 28*a* can be coupled to first bubbler 21*a*, a second supply line 28*b* can be coupled to second bubbler 21*b* and a third supply line 28*c* can be coupled to third bubbler 21*c*. Each bubbler 21 can include any suitable activation element 32, such as a button 32, that can be used by the operator of the drinking fountain 22 to initiate the flow of water from the bubbler. Each supply line 28 can include a first or high-pressure portion 33 and a second or low-pressure portion 34, and can be provided with a flow restrictor 36 of any suitable type between portions 33, 34 for reducing the high-pressure water in first portion 33 a to low-pressure water in second portion 34 that is suitable for use in a drinking fountain bubbler, such as bubblers 21 of drinking fountains 22.

Drain assembly 41 of the invention can include a reservoir 42 for receiving accumulated water in any or all of supply lines 28 when the respective hydrant 21 is not in use, for example not activated by a user. In some embodiments, the reservoir 42 of drain assembly 41 is included in a housing 43, which can be of any suitable type. In some embodiments, housing 43 is made from any suitable material such as metal or plastic.

A piston 46 or other suitable movable element or member can be slidably disposed within housing 43 for at least partially forming the reservoir 42 and varying the volume of the reservoir. Piston 46, which can be made from any suitable material such as metal or plastic, can include a first or lower head 47, which can be referred to as a lower or master piston, and a second or upper head 48, which can be referred to as an upper or slave piston. A shaft or other elongate element or member 49 can join the lower head 47 to the upper head 48. Piston 46 can be made as a single or unitary body, or lower head 47, upper head 48 and shaft 49 can be separately formed or made and joined together to form the piston 46. The housing 43 can include a first or lower portion 51 for slidably receiving master piston 47 and a second or upper portion 52 for slidably receiving slave piston 48. The portions 51,52 of the housing 43 can be separated by an internal wall 53 having an opening 54 through which the shaft 49 of the piston 46 can extend. The upper head 48 can have a suitable sealing member 61 extending around its outer periphery for engaging the inner wall of upper portion 52 of the housing 43 and forming a fluid-tight seal between the upper head 48 and the upper portion 52. The sealing member 61 can be of any suitable type such as an annular O-ring made from any suitable elastomeric material.

The lower head 47 of piston 46 serves to at least partially form an internal chamber 66 in lower portion 51 of the housing 43. The lower head 47 can have a suitable sealing member 67 extending around its outer periphery for engaging the inner wall of lower portion 51 of the housing 43 and forming a fluid-tight seal between the lower head 47 and the lower portion 51. The sealing member 67 can be of any suitable type such as an annular O-ring made from any suitable elastomeric material.

Piston 46 is movable within housing, for example upwardly and downwardly, between a first or lower position, for example shown in FIG. 1, and a second or upper position, for example shown in FIGS. 2 and 3. A spring 71, such as a coil spring, can extend around piston shaft 49 between internal wall 53 and lower head 47 for urging the lower head 47, and thus piston 46, to its first or lower position. A bore or passageway 72 extends vertically through piston 46, commencing at an opening 73 in the bottom surface of lower head 47 and terminating at an opening 74 in the upper surface of upper head 47. Bore 72, in some embodiments, is vertically centered on the piston 46. In some embodiments, when upper head 48 of the piston 46 is in its first position, the volume of reservoir 42 is maximized. In some embodiments, movement of the upper head 48 to it second position serves to minimize the volume of reservoir 42, and in some instances reduce the volume of the reservoir 42 to zero.

Figure 4:
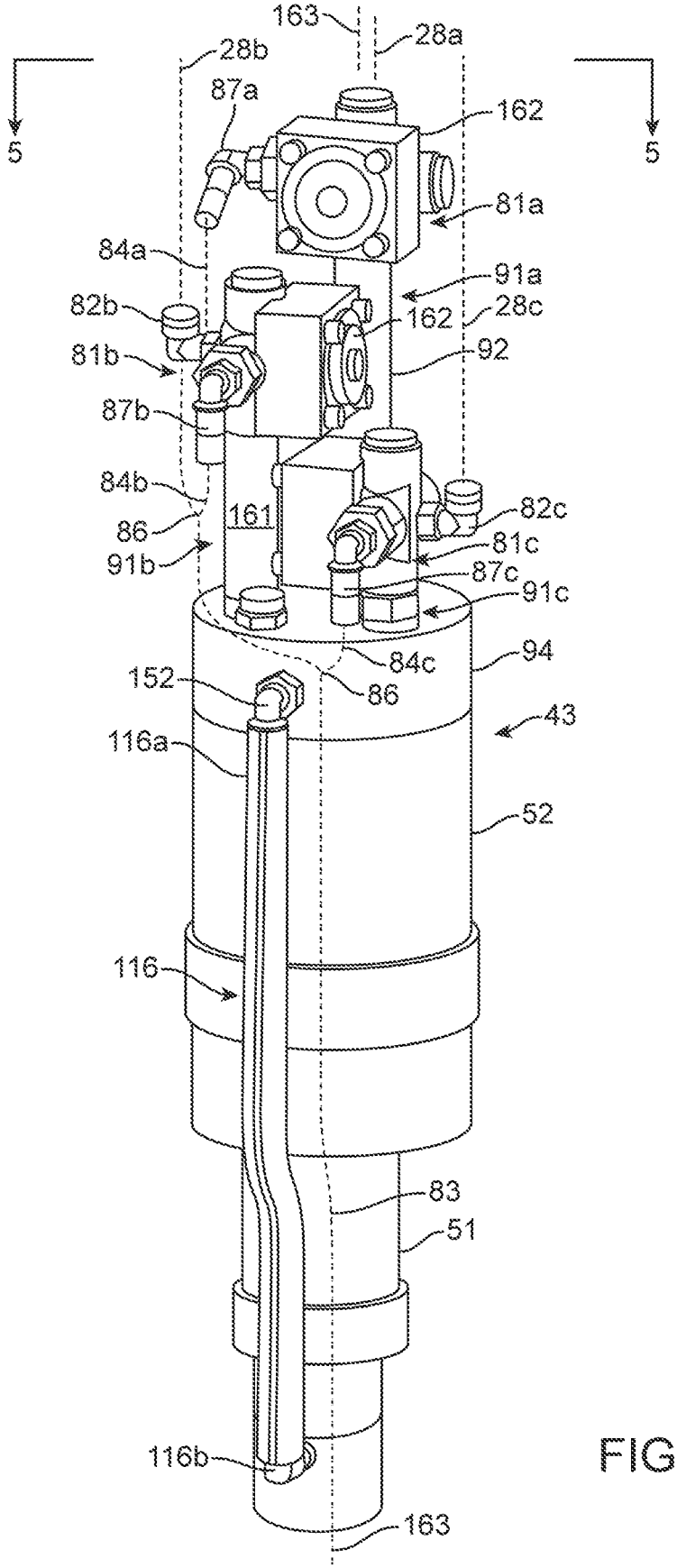
FIG. 4 is an isometric view of an embodiment of the drain assembly of FIG. 1.
Figure 5:
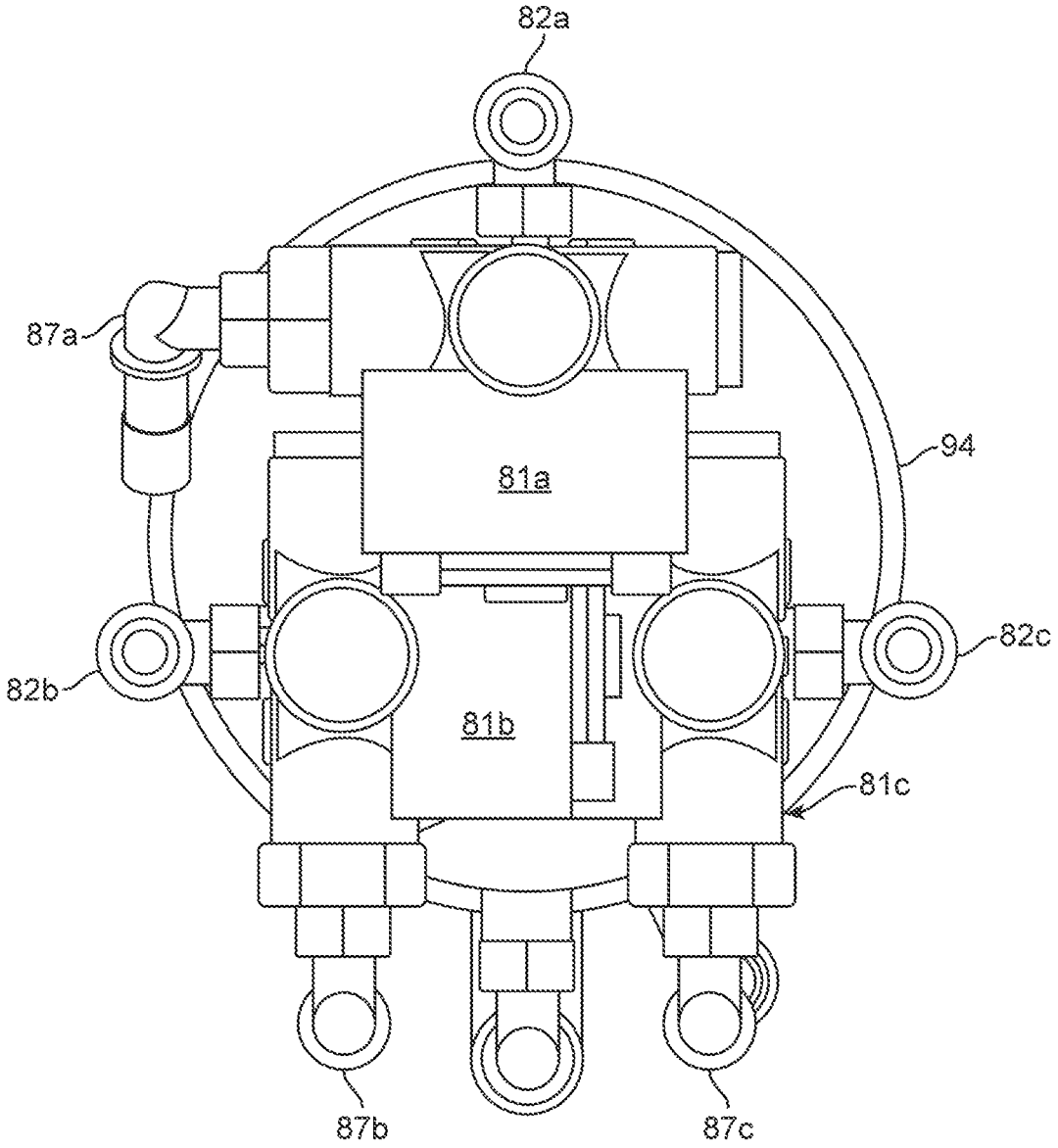
FIG. 5 is a top plan view of the drain assembly of FIG. 4 taken along the line 5-5 of FIG. 4.
Figure 6:
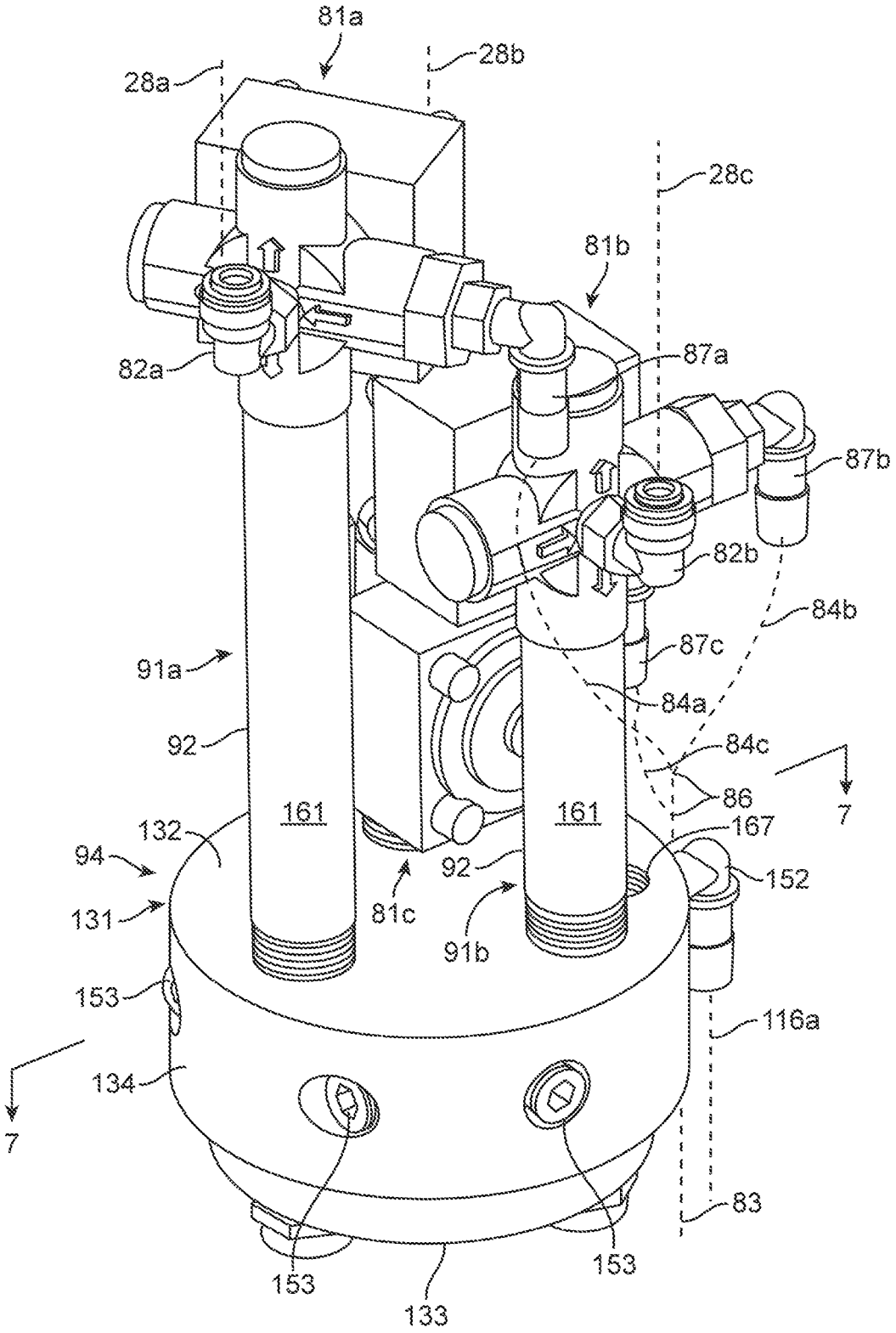
FIG. 6 is an isometric view of a portion of the drain assembly of FIG. 4 in a second configuration.
Figure 7:
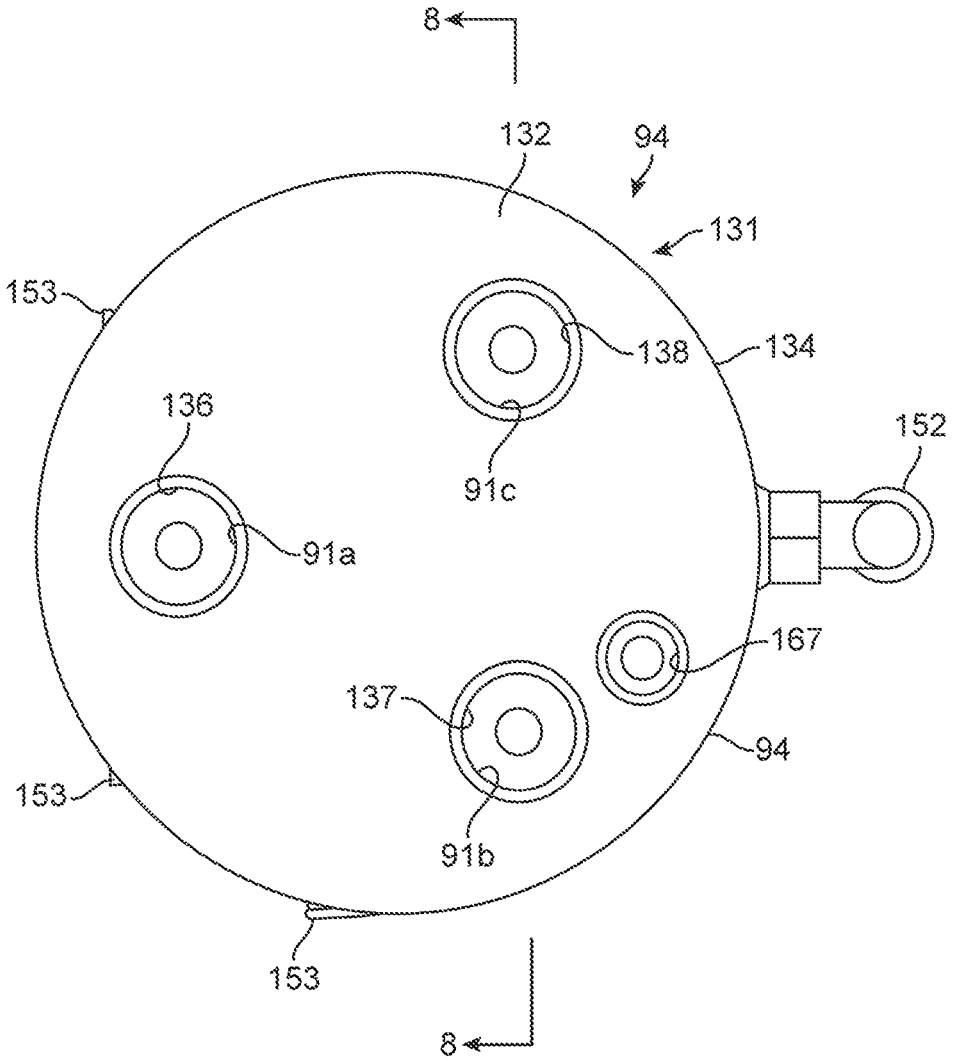
FIG. 7 is a plan view of a portion of the drain assembly of FIG. 6 taken along the line 7-7 of FIG. 6.

One or more supply or control valves 81 can be provided for supplying water or another liquid to the one or more hydrants or outlets 21 by the respective one or more supply lines 28. The supply valves 81 can be of any suitable type, such as made by Metcraft Industries, Inc. of Lee's Summit, Mo. In some embodiments, a first supply valve 81*a* is fluidly coupled to first supply line 28*a* for providing water to first bubbler 21*a*, a second supply valve 81*b* is fluidly coupled to second supply line 28*b* for providing water to second bubbler 21*b* and a third supply valve 81*c* is fluidly coupled to third supply line 28*c* for providing water to third bubbler 21*c*. A suitable fluid outlet connector 82 of any suitable type, for example an elbow 82, can be provided to fluidly couple each of the supply valves 81 to its respective supply line 28. In this regard, a first outlet connector 82*a* can be utilized with first supply valve 81*a*, a second outlet connector 82*b* can be utilized with second supply valve 81*b* and a third outlet connector 82*c* can be utilized with third supply valve 81*c* for fluidly connecting the supply valve 81 to its respective supply line 28 (see FIGS. 4-6). Each of the supply valves 81 can be connected or coupled in any suitable manner (not shown) to the activation element 32 of the respective bubbler 21 so that the supply valve 81 can be controlled by the activation element 32 between its OFF position and its ON position.

Water source 31 is fluidly coupled to each of the supply valves 81 for providing inlet water to the supply valves. A common inlet supply line 83 can extend from the water source 31 to each of the supply valves 81. In some embodiments, the common inlet supply line 83 is fluidly coupled to the supply valves 81 by a plurality of individual inlet supply lines 84, for example first individual inlet supply line 84*a* to first supply valve 81*a*, second individual inlet supply line 84*b* to second supply valve 81*b* and third individual inlet supply line 84*c* to third supply valve 81*c*. The individual inlet supply lines 84 can be directly or sequentially fluidly connected to the common inlet supply line 83 in any suitable manner, for example by one or more suitable Y fluid connectors 86. A suitable fluid inlet connector 87 of any suitable type, for example an elbow 87, can be provided to fluidly couple each of the individual inlet supply lines 84 to its respective supply valve 81. In this regard, a first inlet connector 87*a* can be utilized with first supply valve 81*a*, a second inlet connector 87*b* can be utilized with second supply valve 81*b* and a third inlet connector 87*c* can be utilized with third supply valve 81*c* for fluidly connecting the supply valve 81 to its respective individual inlet supply line 84 (see FIGS. 4-6).

One or more drain lines 91 can be provided for draining remaining water in the respective one or more supply lines 28 to reservoir 42 after the respective supply valve 81 of the supply line 28 has been turned OFF (see FIGS. 1-4 and 6). Each of the drain lines 91 can be referred to as a liquid-carrying line, a liquid line, a fluid-carrying line or a fluid line. In some embodiments, a first drain line 91*a* is fluidly coupled to first supply line 28*a* for permitting remaining water in the first supply line to drain into reservoir 42, a second drain line 91*b* is fluidly coupled to second supply line 28*b* for permitting remaining water in the second supply line to drain into reservoir 42 and a third drain line 91*c* is fluidly coupled to third supply line 28*c* for permitting remaining water in the third supply line to drain into the reservoir 42. In some embodiments, one or more of the drain lines 91 is fluidly coupled to the respective supply valve 81 for permitting the remaining water in the respective supply line to drain from the supply line through the supply valve into the drain line and then reservoir 42. In some embodiments, each of the drain lines 91 has an upper portion 92 extending above housing 43, for example between the housing and the respective supply valve 81, and a lower portion 93 extending through a portion of the housing 43, for example a third or upper end portion 94 of the housing. In some embodiments, the lower surface of housing portion 94 is above reservoir 42, for example forms the upper surface or wall of the reservoir 42.

One or more drain valves 96 can be provided for controlling or limiting the flow of supply water from the one or more supply lines 28 to reservoir 42 under certain circumstances or conditions (see FIGS. 1-3 and 8). The one or more drain valves 96 can each be referred to as a check valve or a selective check valve, for example a valve for limiting flow therethrough in at least one direction under certain circumstances or conditions or a valve for limiting flow therethrough in a first direction under certain circumstances or conditions and in a second direction under certain other circumstances or conditions. In some embodiments, each of the one or more drain lines 91 flows through a respective drain valve 96 before reaching reservoir 42. In some embodiments, a first drain valve 96*a* is fluidly coupled to first drain line 91*a*, a second drain valve 96*b* is fluidly coupled to second drain line 91*b* and a third drain valve 96*c* is fluidly coupled to third drain line 91*c*. The first supply valve 81*a* can be said to be coupled to the first drain valve 96*a*, the second supply valve 81*b* can be said to be coupled to the second drain valve 96*b* and the third supply valve 81*c* can be said to be coupled to the third drain valve 96*c*, in each case for permitting water to be drained from the respective supply line 28 when the respective bubbler 21 is OFF. In some embodiments, drain valves 96 are located or formed in housing 43, for example in the upper end portion 94 of the housing 43.

Drain valves 96 can be of any suitable type, for example as shown in FIGS. 1-3 and 8. In some embodiments, each of the valves 96 includes a chamber 101 (see FIG. 8). A first valve seat 102 and a second valve seat 103 can open into the chamber 101. In some embodiments, the chamber 101 can be formed in upper end portion 94 of the housing 43. In some embodiments, the respective drain line 91 passes through the valve 96. In this regard, the first valve seat 102 can be located in chamber 101 at one location where the drain line 91 opens into the chamber 101 and the second valve seat 103 can be located in chamber 101 at another location where the drain line opens into the chamber 101. In some embodiments, first valve seat 102 is opposite second valve seat 103. In some embodiments, the second valve seat 103 is below the first valve seat 102. In some embodiments, the drain line 91 opens into the top of reservoir 42 at one of the valve seats 102, 103, for example at second valve seat 103. In some embodiments, a first sealing element 106 is disposed around first valve seat 102 and a second sealing element 107 is disposed run second valve seat 103. Each of the sealing elements can be of any suitable type, for example an annular element such as an elastomeric O-ring.

Figure 8:
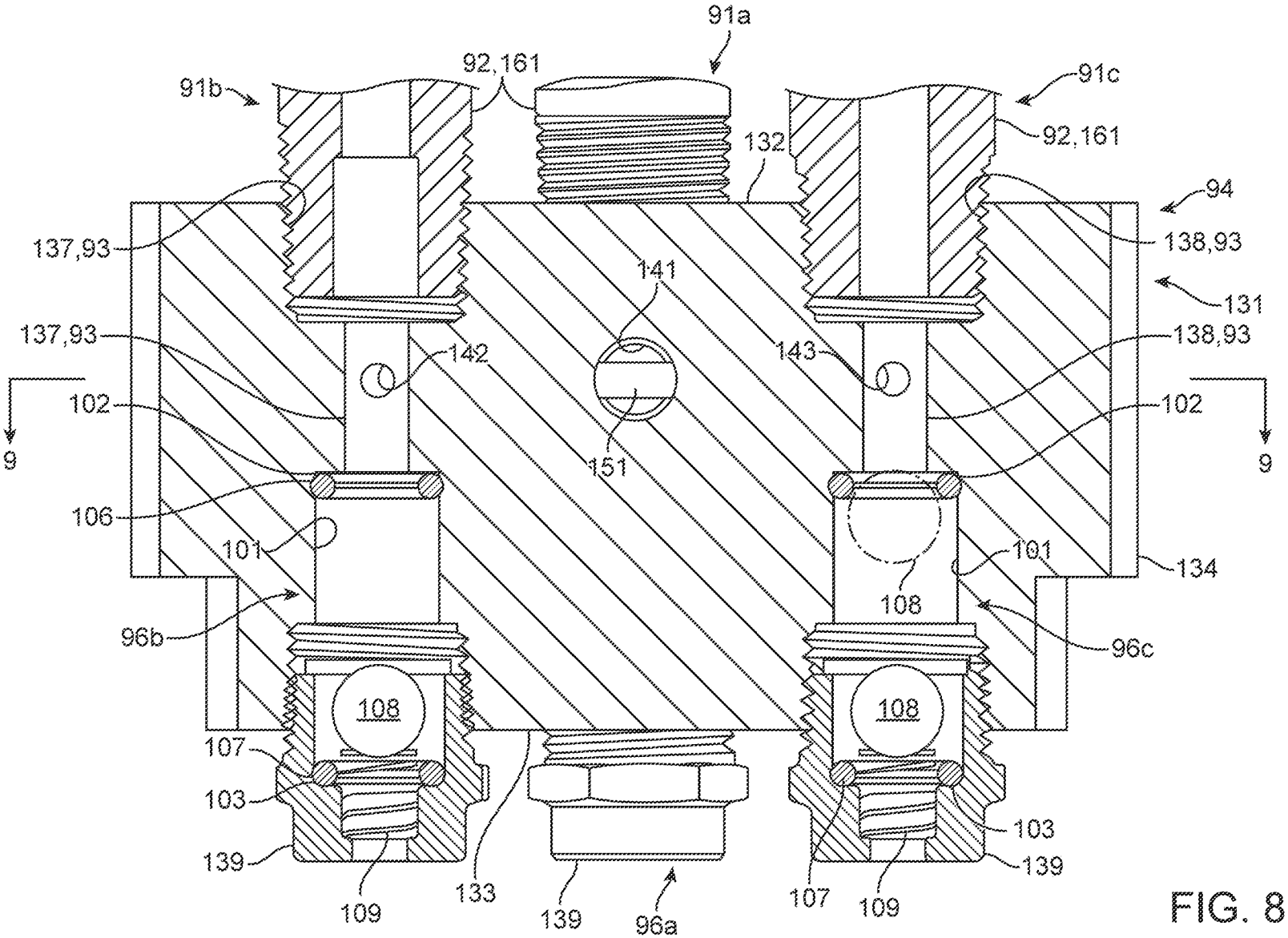
FIG. 8 is a cross-sectional view of the portion of the drain assembly of FIG. 6 taken along the line 8-8 of FIG. 7.

A suitable part 108, such as a ball 108, can be disposed in the chamber 101 and movable between a first position in which the ball sealably engages the first valve seat 102 for inhibiting flow through the first valve seat, a second position in which the ball sealably engages the second valve seat 103 for inhibiting the flow through the second valve seat and a third position in which the ball is nonsealably disposed between the first valve seat 102 and the second valve seat 103. For example, ball 108 is shown in its third position in first drain valve 96*a* of FIG. 2, is shown in its first position in phantom lines in third drain valve 96*c* in FIG. 8 and is shown in its third position in second and third drain valves 96*b* and 96*c* in FIG. 8. A spring 109 can be provided in chamber 101, for example in one of the valve seats 102, 103, for urging the part or ball 108 away from sealing engagement with such valve seat. For example, spring 109 can extend through second valve seat 103 for urging ball 108 away from the second valve seat, as illustrated in FIG. 8. The part or ball 108 can be free in chamber 101, that is not attached to any part of the drain valve 96 and thus able to freely move about chamber 101. For example, the part or ball 108 can be free of the spring 109. It is appreciated that drain valve 96 can have applications outside of a drain assembly for use with one or more hydrants, and in fact can be used in any other suitable application.

Drain assembly 41 can include a supply line 116 for providing pressurized water to housing 43 for moving piston 46 from its first position to a second position. For example, supply line 116, which can be referred to as a piston supply line 116, can supply pressurized water from water source 31 to internal chamber 66 for acting on master piston head 47 so as to move the slave piston head 48 upwardly from its first position to a second position in upper portion 52 of the housing 43. In some embodiments, piston supply line 116 has a first end portion 116*a* fluidly coupled to one or more of supply lines 28, for example at one or more ports 117, and a second end portion 116*b* fluidly coupled to internal chamber 66 in lower portion 51 of the housing 43, for example at port 118. In some embodiments, piston supply line 116 has a first end portion 116*a* fluidly coupled to first supply line 28*a* at first supply port 117*a*, to second supply line 28*b* at second supply port 117*b* and to third supply line 28*c* at third supply port 117*c*. In this manner, piston supply line 116 can be said to be sequentially coupled to first supply line 28*a*, second supply line 28*b* and third supply line 28*c*, and first supply port 117*a*, second supply port 117*b* and third supply port 117*c* can be said to be disposed in series along first end portion 116*a* of the piston supply line. The first end portion 116*a* of the piston supply line 116 can be directly or indirectly coupled to the one or more supply lines 28. In some embodiments, the first end portion 116*a* is coupled to the respective drain line 91 of a supply line 28 and thus indirectly coupled to the supply line. For example, first end portion 116*a* can be fluidly coupled to first drain line 91*a* at first supply port 117*a*, to second drain line 91*b* at second supply port 117*b* and to third drain line 91*c* at the third supply port 117*c*.

In some embodiments, first end portion 116*a* of the piston supply line 116 can be fluidly coupled to each of the one or more supply lines 28 by a respective valve 121. For example, first end portion 116*a* can be fluidly coupled to first supply line 28*a* by first valve 121*a*, to second supply line 28*b* by second valve 121*b* and to third supply line 28*c* by third valve 121*c*. In some embodiments, each of the check valves 121 can be indirectly fluidly coupled to the respective supply line 28 by being fluidly coupled to the respective drain line 91 of the supply line 28. In this manner, piston supply line 116 can be said to be sequentially coupled to first valve 121*a*, second valve 121*b* and third valve 121*c*, and first valve 121*a*, second valve 121*b* and third valve 121*c* can be said to be disposed in series along first end portion 116*a* of the piston supply line. Each of the valves 121 can be of any suitable type, for example a check valve of any suitable type. In some embodiments, each of the valves 121 includes a valve seat 122 adjacent the respective supply port 117, a suitable sealing element or member 123 such as an elastomeric O-ring disposed around the valve seat 122 and a movable part 124 (see FIGS. 9-10). The movable part 124, which can be circular, spherical or a ball, can be movable between a first position in which the part 124 sealably engages the valve seat 122 for inhibiting flow through the valve seat and a second position in which the part is not disposed in the valve seat, for example nonsealably disposed in the valve 121 away from the valve seat 122, for permitting fluid flow through the valve seat 122 and valve 121. For example, part 124 is shown in its first position in each of first valve 121*a*, second valve 121*b* and third valve 121*c* in FIG. 9 and is shown in its second position in first valve 121*a* and third valve 121*c* in FIG. 10. In some embodiments, valves 121 are located or formed in housing 43, for example in the upper end portion 94 of the housing 43.

In some embodiments, upper end portion 94 of the housing 43 contains all of one or more valves 121 and is easily configurable to have a single valve 121, two valves 121 or three valves 121. In some embodiments, the upper end portion 94 is of a compact design and shape, for example having a relatively small radial or transverse dimension so as to facilitate placement of the upper end portion 94 and thus housing 43 in a hole in the ground or into a housing in the ground having a relatively small transverse dimension. In some embodiments, the upper end portion 94 contains all of one or more valves 121 and all of one or more drain valves 96.

In some embodiments, upper end portion 94 of the housing 43 is made from a body 131, which can be a unitary body of a single material or a laminated body made of a single or multiple materials (see FIGS. 6-10). End portion 94, including body 131, can be referred to as a cap 94. In some embodiments, the body 131 is a unitary body made from any suitable material such as brass or plastic. In some embodiments, the body 131 can have a first surface 132 and an opposite second surface 133 and an outer peripheral surface extending between the first and second surfaces 132, 133. In some embodiments, the first and second surfaces 132, 133 can be planar, and can be parallel to each other. In some embodiments, the outer peripheral surface 134 can be circular in shape. The body 131 can be in the shape of a disk.

In some embodiments, the body 131 is provided with a first bore 136, a second bore 137 and a third bore 138 extending through first surface 132. In some embodiments, each of the bores 136-138 extend through both the first surface 132 and the second surface 133. The bores 136-138 can be parallel to each other, and in some embodiments extends perpendicularly of surfaces 132, 133. For simplicity herein, each of the bores 136-138 can be referred to herein as a vertical bore. The bores 136-138 can correspond to lower portion 93 a first drain line 91*a*, second drain line 91*b* and third drain line 91*c*. The bores 136-138 can be adapted to respectively coupled to drain lines 91*a*-91*c*, for example at first surface 132 of the body 131. In this manner, the bores 136-138 are adapted to respectively coupled to first supply line 28*a*, second supply line 28*b* and third supply line 28*c*, that is indirectly through drain lines 91. When body 131 is viewed in plan, for example at first surface 132 as illustrated in FIG. 8, bores 136-138 are equally spaced apart from each other so as to form a triangular configuration on surface 132, for example with each bore 136-138 at a corner of such imaginary triangle. Drain valves 96 can be formed at the bottom of the respective bores 136-138, for example first drain valve 96*a* can be provided at the bottom of first bore 136, second drain valve 96*b* can be provided at the bottom of second bore 137 and third drain valve 96*c* can be provided at the bottom of third bore 138 (see FIG. 8). The drain valves 96 can be formed entirely in body 131, partially in body 131 or entirely within an insert such as an externally-threaded annular body that is threaded into the bottom of the respective bore 136-138. In some embodiments, as shown in FIG. 8, each of the drain valves 96 is formed partially in body 131 and partially within an externally-threaded annular body 139 threaded into the bottom of the respective bore 136-138.

In some embodiments, body 131 is provided with a bore extending through outer or cylindrical surface 134 to each of vertical bores 136-138. In some embodiments, each of such bores through surface 134 extends parallel to one or both of surfaces 132, 133. For simplicity herein, each of such bores through surface 134 can be referred to herein as a horizontal or valve bore. For example, a first valve bore 141 can extend through surface 134 to first vertical bore 136, a second valve bore 142 can extend through surface 134 to second vertical bore 137 and a third valve bore 143 can extend through surface 134 to third vertical bore 138 (see FIGS. 9-10). In some embodiments, the valve bores 141-143 extend parallel to each other, for example in a single plane. In some embodiments, the valve bores extend perpendicular to the vertical bores 136-138. In some embodiments, each of the valve bores 141-143 communicates with its respective vertical bore 136-138, which corresponds to a drain line 91, at a valve seat, for example the valve seat 122 of the respective check valve 121. For example first valve bore 141 communicates with first vertical bore 136, which corresponds with first drain line 91*a*, at valve seat 122 of first check valve 121*a*, second valve or 142 communicates with second vertical bore 137, which corresponds with second drain line

91*b*, at valve seat 122 of second check valve 121*b* and third valve bore 143 communicates with third vertical bore 138, which corresponds with third drain line 91*c*, at valve seat 122 of third check valve 121*c*. Each of the valve bores 141-143 can communicate with its respective vertical bore 136-138 at a port, for example a supply port 117. A connecting bore 144 extends through outer or cylindrical surface 134 through each of the valve bores 141-143 so as to interconnect the valve bores 141-143 to each other. In some embodiments, the connecting bore 144 can extend perpendicularly of the valve bores 141-143.

In some embodiments, the connecting bore 144 intersects each of the valve bores 141-143 near the end of the valve bore and near the respective vertical bore 136-138 so as to be in the vicinity of the respective valve seat 122. In some embodiments, valve bores 141-143 extend parallel to each other in a single plane and connecting bore 144 extends perpendicularly of the valve bores 141-143 in such plane. In such some embodiments, one of the vertical bores 136-138 is on the opposite side of the connecting bore 144 from the two other vertical bores 136-138. In this manner, one of the check valves 121 is on the opposite side of the connecting bore 144 from the two other check valves 121. Such one of the vertical bores, for example first valve bore 141, can extend between the other two vertical bores, for example second and third valve bores 142-143.

Each of the check valves 121 in body 131 can be assembled by inserting the sealing element 123 through the respective valve bore 141-143 into the respective valve seat 122 near the end of the valve bore. A movable part or ball 124 can then be inserted into the respective valve bore 141-143. An elongate member or element 151, which can be referred to as a limiting element or rod 151, is inserted into the connecting bore 144, for example along the length of the connecting bore. Limiting element 151 extends across or transversely through each of the valve bores 141-143. The movable part or ball 124 is disposed between the limiting rod 151 and the valve seat 122 of the check valve 121. The limiting rod 151 is sufficiently spaced from the valve seat 122 so as to retain the movable part or ball 124 in the vicinity, or sealing proximity, of the valve seat so that during operation of the check valve 121 the part 124 can move between its first position in which the part 124 is in sealing engagement with the valve seat 122 and its second position in which the part 124 is away from the valve seat 122. When in its second position, part 124 is not in sealing engagement with the valve seat 122, but in the vicinity or sealing proximity of the valve seat. One of the valve bores 141-143, for example first valve bore 141, can be fluidly coupled to piston supply line 116 by any suitable fluid coupling device or connector 152 such as an elbow 152 joined to the opening of the bore at peripheral surface 134. Such opening and elbow 152 can serve as an outlet port for cap 94. Each of the other two of the valve bores 141-143, for example second valve bore 142 and third valve bore 143, can be sealed by any suitable closure device or means, for example by a plug 153 threaded into or otherwise secured to the end of the valve bore at outer peripheral surface 134. Similarly, connecting bore 144 can be sealed and limiting rod 151 secured within the connecting bore 144 by any suitable closure device or means, for example by a plug 153 threaded into or otherwise secured to the end of the connecting bore 144 at outer peripheral surface 134.

Valve bores 141-143 and connecting bore 144, together, form first end portion 116*a* of piston supply line 116 in body 131. Check valves 121 are formed in the ends of the respective valve bores 141-143. Piston supply line 116 is thus fluidly coupled to each of the supply lines 28, indirectly by means of the respective drain lines 91. Lower portions 93 of the drain lines 91 are formed by vertical bores 136-138 in the body 131. Body 131, as preformed for example through injection molding with vertical bores 136-138, valve bores 141-143 and connecting bore 141 therein, can be easily configured to accommodate one, two or three supply valves 81. In this regard, when less than three supply valves 81 are to be utilized with body 131, the unused vertical bores 136-138 can be capped or otherwise sealed at first and second surfaces 132-133 and check valves 121 not formed in the unused valve bores 141-143. Similarly, drain valves 96 are not formed in the unused vertical bores 136-138.

The one or more supply valves 81 can be disposed above upper end portion 94 of housing 43 in any suitable manner. In some embodiments, upper portions 92 of the drain lines 91 can connect the supply valves 81 to end portion 94 in any suitable manner. Remaining water in supply lines 28 and drain lines 91 flows by gravity into housing 43, including reservoir 42 in the housing. The one or more supply valves can be arranged above housing 43 in a compact configuration, for example a configuration which minimizes the radial or transverse dimension of the assembly of valves 81. In some embodiments, such radial transverse dimension of the assembly of valves approximates the radial transverse dimension of the housing 43. In some embodiments, each supply valve 81 is aligned relative to housing 43 so as to be above its respective drain valve 96. For example, each of the supply valves 81 or its respective drain line 91 can be in linear or vertical alignment with its respective drain valve 96. Such vertical alignment, which in some embodiments is enhanced or permitted by the transverse or spatial arrangement of the drain valves 96 in the horizontal plane of end portion 94, as illustrated for example in FIG. 7, can reduce the complexity and size of drain assembly 41. In some embodiments, supply valves 81 are secured to body 131 by pipes 161, which can form part of drain lines 91, including upper portions 92 of the drain lines. The bottom end of each pipe 161 can be secured to housing in any suitable manner, for example threadedly secured to the top end of the respective vertical bore 136-138 in body 131.

In some embodiments, the one or more supply valves 81 are sequentially placed above each other relative to the housing 43, for example to permit or enhance radially compact nesting of the valves 81. In some embodiments, the supply valves 81 are staggered relative to each other in such vertical arrangement. For example, as discussed above, the supply valves 81 can be spaced apart relative to the horizontal plane of the housing 43 to permits such staggering. In some embodiments, for example where one or more of supply valves 81 is not vertically centered on its respective drain line 91 and thus has a portion 162, which can be called a bulbous portion 162, extending transversely or sideways of the vertical axis of the drain line 91, the supply valve 81 can be aligned on the drain line, for example on its respective pipe 161, such that the bulbous portion 162 extends towards the vertical centerline 163 of drain assembly 41 (see FIGS. 4-6).

Drain assembly 41 can be provided with a suitable line or drain 166 for permitting water pushed out of reservoir 42 by piston 46 to exit the assembly 41. The drain line 166 can extend from the reservoir 42, for example, to drain 26 (see FIGS. 1-3). In some embodiments, end portion or cap 94 is provided with a bore 167 having a bottom end communicating with the reservoir 42, for example the top of the reservoir, and a top end exiting the top of cap 94 and fluidly communicating with a suitable tube or line 168 extending to drain 26.

Some methods of operation of the invention are now discussed. Drain assembly 41 can be placed in the ground, for example in a chamber, housing or hole provided in the ground. The entire assembly 41 can be below ground level, shown by reference number 211 in FIGS. 1-3. At least reservoir 42, and in some embodiments check valves 121 and drain valves 96, are placed below the frost line, shown by reference number 212 in FIGS. 1-3. FIG. 2 illustrates the operation of drain assembly 41 when first supply valve 28*a* is activated, for example by a user of drinking fountain 22*a* activating button 32 of the fountain. Since drinking fountains 22*b* and 22*c* are OFF, first supply valve 81*a* supplies pressurized water from source 31 through first supply line 28*a* to bubbler 21*a* of the fountain 22*a*. The water out first drinking fountain 22*a* discharges to first bowl or basin 23*a* and then common drain 26, for example via first drain 24*a*.

The pressurized water in first supply line 28*a* travels to first drain line 91*a* and forces movable part 108 of first drain valve 96*a* into engagement with second sealing element 107 and second valve seat 103, when the water pressure is sufficient to overcome the force of internal spring 109, to preclude the pressurized supply water from entering reservoir 42 of the housing 43.

Additionally, the pressurized supply water in drain line 91*a* unseats movable part 124 of first check valve 121*a* to permit the pressurized water to enter first end portion 116*a* of piston supply line 116. The piston supply line 116 is connected at its second end portion 116*b* to internal chamber 66, which can be called lower zone 66 in lower housing portion or cylinder 51, situated below first or lower piston head 47 in the cylinder 51. The pressurized supply water in internal chamber 66 causes lower piston and 47 to move upwardly, against the force of spring 71, and additionally causes the upper piston head 48, rigidly connected to the lower piston head 47 by shaft 49, to move upwardly within reservoir 42. When first supply valve 81*a* is ON, the water pressure is greater at first portion 33 of the supply line 28*a* than in second portion 34 of the supply line because of variable flow restrictor 36. This enables maximum water pressure to operate piston 46, by for example by engaging lower piston and 47 in internal chamber 66, and the minimum water required to the drinking fountain 22. The movement of the upper piston head 48 to it second position drives any accumulated water in the reservoir 42 out of the reservoir through reservoir drain line 166. The pressurization of the accumulated water in reservoir 42 by the movement of piston 46 to it second position serves to move movable part 108 in each of second drain valve 96*b* and third drain valve 96*c*, which are not pressurized by respective drain lines 91*b*, 91*c* due to respective supply valves 81*b*, 81*c* being OFF, into sealing engagement with the first valve seat 102 of each of such drain valves so as to prevent the accumulated water from traveling or backflowing into drain lines 91*b*,91*c* and supply lines 28*b*, 28*c*. Although internal chamber 66 is connected to reservoir 42 by bore 72, the bore 72 is transversely or diametrically sized small enough so that any pressurized water flowing therethrough to reservoir 42 is not sufficient to decrease the force necessary to move the piston 46 upwardly against the force of spring 71. When any one or more of the supply valves 81 is operated independently, consecutively or at the same time, pressure in internal chamber 66 moves piston 46 up discharging stored water in reservoir 42 out bore 167 and tube 168 to airgap 27 and drain 26.

The pressurized water within first end portion 116*a* of the piston supply line 116 engages the movable parts 124 of each of second check valve 121*b* and third check valve 121*c* to move each of the movable parts 124 into engagement with respective valve seats 122 and thus inhibit or preclude the pressurized water within the piston supply line 116 from entering second supply line 28*b* or third supply line 28*c*. This prevents second bubbler 21*b* of the second fountain 22*b* and the third bubbler 21*c* of the third fountain 22*c* from undesirably discharging at the same time the first supply valve 81*a* is in an ON position.

When the first supply valve 81*a* is turned OFF, the reduced pressure in first drain line 91*a* causes spring 109 to disengage the movable part 108 of the first drain valve 96*a* from the second sealing element 107 and second valve seat 103 so as to permit the now depressurized water within first supply line 28*a* and first drain line 91*a* to pass the first drain valve 96*a* and gravity drain into reservoir 42. Similarly, piston supply line 116 is depressurized and spring 71 urges the piston 46 downwardly from its second position to its first position. The movement of the piston 46 to its first position re-creates reservoir 42 within upper housing portion 52 and permits any water within reservoir drain line 166 to gravity flow into the reservoir 42. The now depressurized water in internal chamber 66 bleeds under the force of piston 46 moving from it second position to its first position from the internal chamber 66 through bore 72 into reservoir 42. FIG. 1 illustrates depressurized water within first and second supply lines 81*a*, 81*b*, first and second drain lines 91*a*, 91*a* and reservoir drain line 166 gravity flow draining into reservoir 42.

In another method of operation, when second supply valve 81*b* is ON and first supply valve 81*a* and third supply valve 81*c* are OFF, second supply valve 81*b* supplies water pressure through second supply line 28*b* to second bubbler 21*b* of the second drinking fountain 22*b*. Simultaneously, the second supply valve 81*b* supplies pressurized water past second check valve 121*b* to piston supply line 116 and thus internal chamber 66 within lower housing portion 51 so as to move the piston 46 upwardly from its first position to its second position and thus empty the contents of reservoir 42 through reservoir drain line 166. When the piston supply line 116 is pressurized, first check valve 121*a* and third check valve 121*c* are closed to prevent first bubbler 21*a* and third bubbler 21*c* from discharging at the same time that the second supply valve 81*b* is ON. The pressurized water within second supply line 28*b* pressurizes second drain line 91*b* so as to close second drain valve 96*b*, by forcing movable part 108 against second sealing element 107 in second valve seat 103 of the drain valve when the pressure within the drain line 91*b* exceeds that needed to overcome spring 109, so as to prevent water from the second drain line 91*b* entering reservoir 42. The pressurization of the accumulated water in reservoir 42 by the movement of piston 46 to it second position serves to move movable part 108 in each of first drain valve 96*a* and third drain valve 96*c*, which are not pressurized by respective drain lines 91*a*, 91*c* due to respective supply valves 81*a*, 81*c* being OFF, into sealing engagement with the first valve seat 102 of each of such drain valves so as to prevent the accumulated water from traveling or backflowing into drain lines 91*a*,91*c* and supply lines 28*a*, 28*c*.

In another method of operation, two of the supply valves 81 can be activated simultaneously, for example by the activation elements 32 of two of the drinking fountains 22 being activated by two users. An example when first supply valve 81*a* and second supply valve 81*b* are so activated is illustrated in FIG. 3. As shown therein, water travels from the supply valves 81*a*, 81*b* through the respective supply lines 28*a*, 28*b* to respective drinking fountains 22*a*, 22*b*. The pressurized water within supply lines 28*a*, 28*b* pressurizes drain lines 91*a*,91*b* so as to close drain valve 96*a*,96*b*, by forcing movable part 108 against second sealing element 107 in second valve seat 103 of each of the drain valves when the pressure within the drain lines 91*a*, 91*b* exceeds that needed to overcome the respective spring 109, so as to prevent water from the drain lines 91*a*, 91*b* entering reservoir 42. The pressurized water within respective drain lines 91*a*, 91*b* open and thus pass respective check valves 121*a*, 121*b* to enter first end portion 116*a* of the piston supply line 116 and pressurize internal chamber 66. Piston 46 is thus moved upwardly under the pressurized force on lower piston and 47, by compressing spring 71, from its first or lower position to its second or upper position to empty reservoir 42 out bore 167 and tube 168 to airgap 27 and drain 26. Water pressure within piston supply line 116 closes third check valve 121*c*, by urging movable part 124 against sealing element 123 of the check valve 121*c*, to prevent the pressurized water from entering line third drain line 91*c* and thus third supply line 28*c*. The pressurization of the accumulated water in reservoir 42 by the movement of piston 46 to it second position serves to move movable part 108 in third drain valve 96*c*, which is not pressurized by third drain line 91*c* due to third supply valve 81*c* being OFF, into sealing engagement with the first valve seat 102 of the drain valve 96*c* so as to prevent the accumulated water from traveling or backflowing into third drain line 91*c* and third supply lines 28*c*.

Figure 9:
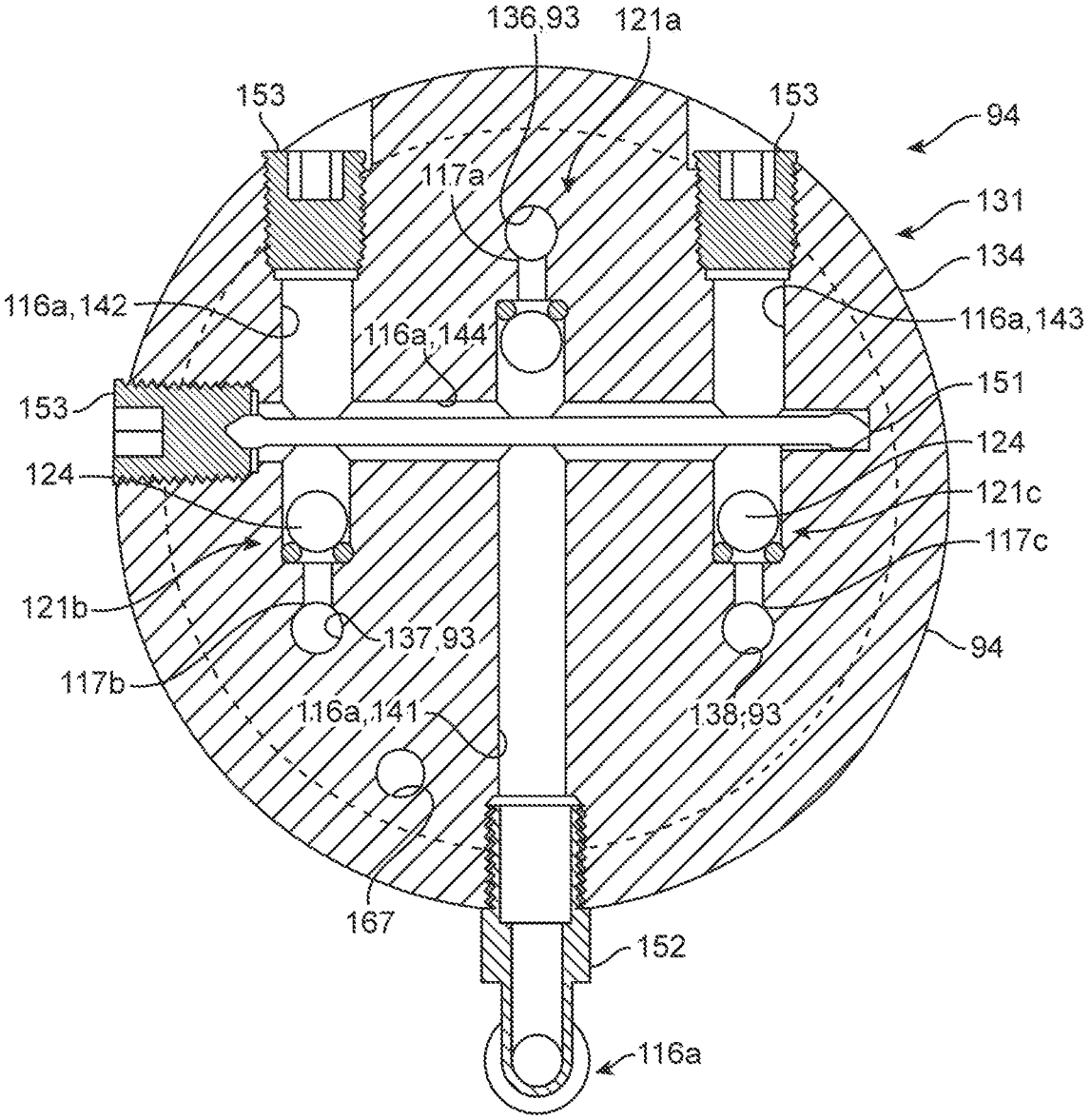
FIG. 9 is a cross-sectional view of the portion of the drain assembly of FIG. 6 taken along the line 9-9 of FIG. 8, in a first configuration.

When all three drinking fountains 22*a*-22*c* are OFF, all three of the supply valves 81*a*-81*c* are OFF. Any water remaining in supply lines 28*a*-28*c* and drain lines 91*a*-91*c* gravity drains through drain valves 96*a*-96*c* into reservoir 42, which is located below the frost line 212 so as to prevent the drinking fountains 22*a*-22*c* from freezing. FIG. 1 illustrates the operation of draining assembly 41 upon turning first and second drinking fountains 22*a*, 22*b* OFF. Water in drinking fountain B1, water in line 92 drains back into line 52 to line 31. Following the depressurization of first supply line 28*a* and first drain line 91*a*, spring 109 of first drain valve 96*a* urges movable part 108 off sealing element 107 to permit water from lines 28*a*, 91*a* to drain into reservoir 42. Similarly, following the depressurization of second supply line 28*b* and second drain line 91*b*, spring 109 of second drain valve 96*b* urges movable part 108 off sealing element 107 to permit water from lines 28*b*, 91*b* to drain into reservoir 42. Similarly, but not shown in FIG. 1, following the depressurization of third supply line 28*c* and third drain line 91*c*, spring 109 of third drain valve 96*c* urges movable part 108 off sealing element 107 to permit water from lines 28*c*, 91*c* to drain into reservoir 42. FIG. 9 illustrates each of check valves 121 in a closed position, for example when all of the supply valves 81 are OFF, as illustrated in FIG. 1.

Figure 10:
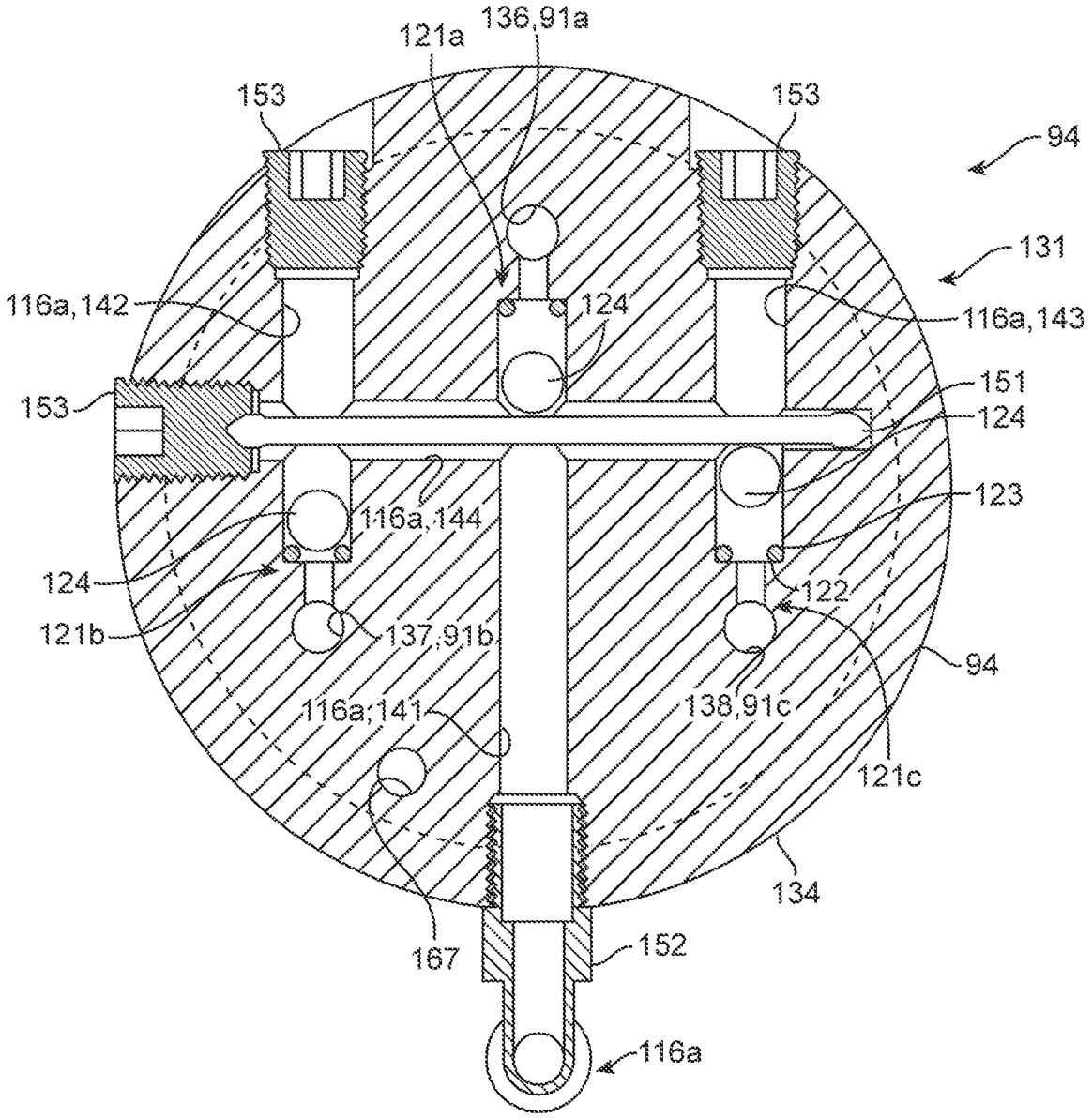
FIG. 10 is a cross-sectional view of the portion of the drain assembly of FIG. 6, similar to FIG. 9 but in a second configuration.

FIG. 10 illustrates first check valve 121*a* and third check valve 121*c* in an open position and second check valve 121*b* in a closed position, for example when first supply valve 81*a* and third supply valves 81*c* are ON and second supply valve 81*b* is OFF.

Figure 11:
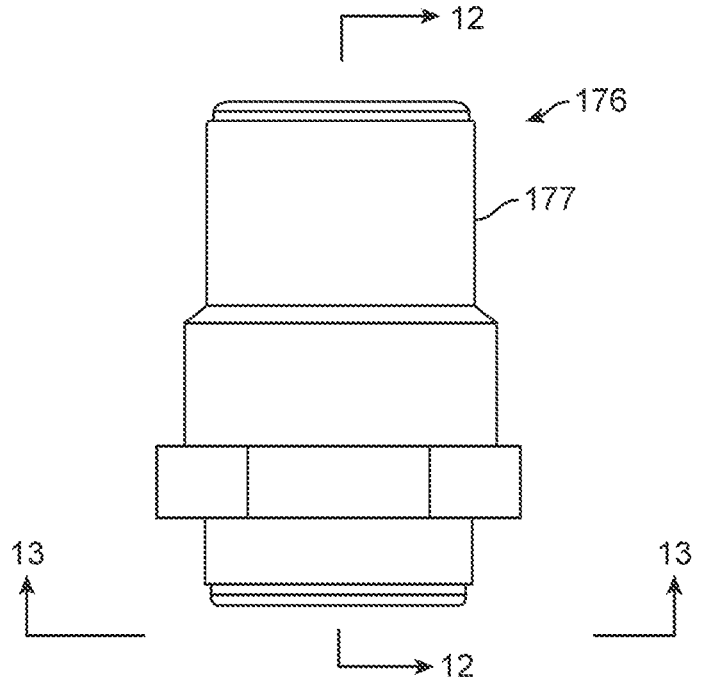
FIG. 11 is an isometric view of a valve which is suitable for use in embodiments of the drain assembly of the present invention.
Figure 12:
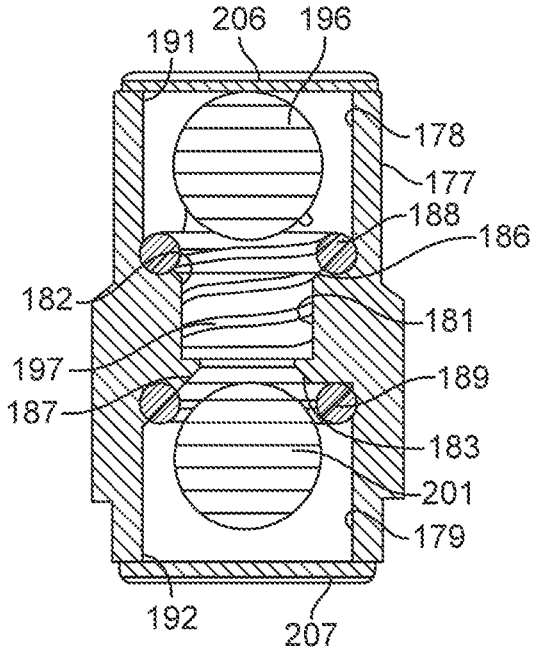
FIG. 12 is a cross-sectional view of the valve of FIG. 11 taken along the line 12-12 of FIG. 11.
Figure 13:
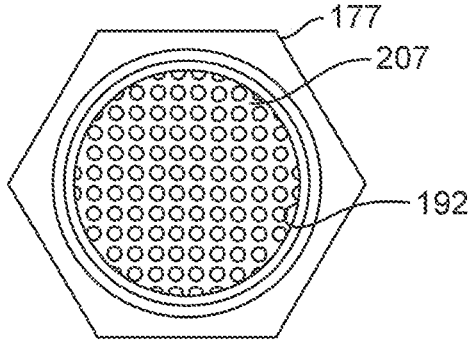
FIG. 13 is a bottom plan view of the valve of FIG. 11 taken along the line 13-13 of FIG. 11.

The drain valves of the invention can have other configurations and designs for use with drain assembly 41 or elsewhere. For example, drain valve 176 illustrated in FIGS. 11-13 can be utilized in drain assembly 41 in place of one or more of drain valves 96. Drain valve 176 can be formed, for example, entirely within a body such as body 131, partially within such a body and partially within an insert to be joined to such body or entirely within an insert which can be joined to such body. For illustration purposes, drain valve 176 is illustrated in FIGS. 11-13 as being formed in a body 177 which can be joined to the bottom of a vertical bore 136-138 of body 131. Body 177, which can be annular and referred to as a housing 177, can be formed from any suitable material such as metal or plastic. Housing 177 has a first chamber 178 and a second chamber 179. A passageway 181 extends between a first opening 182 in the first chamber 178 and a second opening 183 and the second chamber 179. A first valve seat 186 can be provided at the first opening 182 and a second valve seat 187 can be provided at the second opening 183. In some embodiments, a first sealing element or member 188 is provided in the first valve seat 186 and a second sealing element or member 189 71 is provided in the second valve seat 187. Each of such sealing elements or members, which can be annular, can be of any suitable type such as an elastomeric O-ring. First chamber 178 can be provided with another opening 191, for example an outlet opening 191, and second chamber 179 can be provided with another opening 192, for example an outlet opening 192. In some embodiments, opening 182 and first outlet opening 191 of first chamber 178 are linear aligned and opening 183 and second outlet opening 192 of second chamber 179 are linearly aligned. In some embodiments, openings 182 and 191 of the first chamber 178 and openings 183 and 192 of the second chamber 179 are linearly aligned in body 177.

A first movable part 196, which can be circular, spherical or a ball, can be provided in the first chamber 178 and movable between a first or closed position in which the part 191 sealably engages the first valve seat 186 for inhibiting flow through the valve seat and a second or open position in which the part is not disposed in the valve seat, for example nonsealably disposed in the first chamber 178 away from the first valve seat 186, for permitting fluid flow through the first valve seat 186 and first chamber 178. For example, part 196 is shown in its second position in FIG. 12. A spring 197 can be provided in first chamber 178, for example in first valve seat 186, for urging the part 196 away from sealing engagement with the valve seat. For example, spring 197 can extend through the first valve seat 186 for urging part 196 away from the first valve seat, as illustrated in FIG. 12. The part 196 can be free in chamber 178, that is not attached to spring 197 or any part of body 177, and thus able to freely move about the chamber 178. A second movable part 201, which can be circular, spherical or a ball, can be provided in the second chamber 179 and movable between a first or closed position in which the second part 201 sealably engages the second valve seat 187 for inhibiting flow through the valve seat and a second or opened position in which the second part is not disposed in the valve seat 187, for example nonsealably disposed in the second chamber 179 away from the second valve seat 187, for permitting fluid flow through the second valve seat 187 and second chamber 179. For example, part 201 is shown in its first position in FIG. 12. The second movable part 201 can be free in the second chamber 179, for example not attached to any part of body 177, and thus able to freely move about the second chamber.

In some embodiments, a first limiting element 206 can be carried by the housing 177 for retaining the first movable part 196 within first chamber 178, for example within sealing proximity to first valve seat 186, and a second limiting element 207 can be carried by the housing 177 for retaining the second movable part 201 within second chamber 179, for example within sealing proximity to second valve seat 187. Each of the limiting elements 206, 207 can be a porous screen overlying the respective outlet opening 191, 192. In some embodiments, a drain valve 176 is substituted in drain assembly 41 for each drain valve 96 above, for example at the bottom of each vertical bore 136-138, with first outlet opening 191 facing upwardly within housing 43 and second outlet opening 192 facing reservoir 42. It is appreciated that drain valve 176 can have applications outside of a drain assembly for use with one or more hydrants, and in fact can be used in any other suitable application.

In some methods of operation and use of drain valve 176 in drain assembly 41, when pressurized water is provided to outlet opening 191 and thus first chamber 178 of the drain valve 176, for example when a respective supply line 28 and drain line 91 are pressurized due to the respective supply valve 81 being ON, first movable part 196 in the first chamber 178 is forced against first sealing element 188 in first valve seat 186 of the drain valve when the pressure within the drain line 91 exceeds that needed to overcome spring 197, so as to prevent water from the drain line 91 passing through openings 191,192 of the drain valve 176 and entering reservoir 42. When the respective supply valve 81 that provides pressurized water to drain valve 176 is OFF but one of the other supply valves 81 of drain assembly 41 is ON and piston 46 thus moves from its first position to a second position under the force of pressurized water supplied by such ON supply valve 81 through piston supply line 116 to internal chamber 66, the pressurization of the accumulated water in reservoir 42 by the movement of piston 46 to it second position serves to move second movable part 201 in second chamber 179 into sealing engagement against second sealing element 189 in second valve seat 187 so as to prevent the accumulated water from traveling or backflowing through openings 192,191 of the drain valve 176 into the respective drain line 91 and supply lines 28.

The drain assembly of the invention advantageously saves costs by permitting standard parts thereof to be easily configured to accommodate the number of drinking fountains required. In this regard, for example, any one of the three supply valves 81 can be removed and the housing 43 can be capped at the valve exit location, for example where the respective vertical bore 136-138 exits the housing 43.

In one aspect of the invention, a drinking water supply system is provided and includes a drinking bubbler having a supply water inlet, multiple control valves each having a water inlet and a water outlet, a water reservoir and a piston movable therein between UP and DOWN positions, a water delivery line flow connectable to each of said valves, and to said reservoir, at a first side of the piston, whereby for example when the valves are operated to ON position they pass water to flow from a provided supply input and water flows to the bubbler inlet and to the valves from which water flows to the reservoir at one side of the piston, displacing the piston in one direction to exit the reservoir.

All of the valves can be operated to OFF position, and supply water flows to the reservoir at the stored water side of the piston which is displaced in the opposite direction by a spring. The system can include three balls connected respectively in series with the control valves, whereby when all three of said control valves are in an OFF position water flows directly from the bubbler and provided drain lines via check valves through to the reservoir water storage side of the piston. When any combination of the three said control valves are in an ON position the check valves can prevent pressurized water from flowing into the reservoir and can pressurize individual bubblers related to its specific valve. The system can include an additional three balls connected respectively in series with the control valves, whereby when any combination of valves are in an ON position water flows from the control valves to the bubblers via check valves to prevent water from one valve from flowing to multiple bubblers. The piston can be displaced in the opposite direction for driving water from the piston to the exterior, via a path in communication with said control valve and flow restrictions can be provided. All three control valves can be respectively in communication with the three check valves.

In one aspect of the invention, a supply assembly for use in a hydrant to provide water through a first supply line to a first outlet of the hydrant and through a second supply line to a second outlet of the hydrant can be provided and can include a first supply valve adapted for coupling to the first supply line to supply water to the first supply line and a second supply valve adapted for coupling to the second supply line to supply water to the second supply line, a housing containing a first drain valve and a second drain valve, the first supply valve coupled to the first drain valve for permitting water to be drained from the first supply line when the first outlet is off, the second supply valve being coupled to the second drain valve for permitting water to be drained from the second supply line when the second outlet is off, the first supply valve being above the second supply valve to permit radially compact nesting of the first supply valve and the second supply valve.

The first supply valve can be aligned relative to the housing so as to be above the first drain valve and the second supply valve can be aligned relative to the housing so as to be above the second drain valve. The second supply valve can be vertically staggered above the first supply valve. The supply assembly can further include a reservoir below the first and second drain valves for receiving water drained from the first and second supply lines. The supply assembly can provide water through a third supply line to a third outlet, and can further include a third supply valve adapted for coupling to the third supply line to supply water to the third supply line, the housing containing a third drain valve, the third supply valve being coupled to the third drain valve for permitting water to be drained from the third supply line when the third outlet is off, the third supply valve being above the second supply valve. The third supply valve can be aligned relative to the housing so as to be above the third drain valve.

In one aspect of the invention, a supply assembly for use in a hydrant to provide water through a first supply line to a first outlet of the hydrant and through a second supply line to a second outlet of the hydrant can be provided and can include a first supply valve adapted for coupling to the first supply line to supply water to the first supply line and a second supply valve adapted for coupling to the second supply line to supply water to the second supply line, a housing having a reservoir for receiving drain water from the first supply line when the first supply valve is OFF and drain water from the second supply line when the second supply valve is OFF, a piston disposed in the housing and movable from a first position for providing the reservoir and a second position for emptying the reservoir, a piston supply line having a first end coupled to a first check valve and to a second check valve, the first check valve adapted to couple to the first supply line and the second check valve adapted to couple to the second supply line, the piston supply line having a second end coupled to the housing for supplying water to the housing when at least one of the first supply valve and the second supply valve is ON so as to move the piston from its first position to its second position, the first check valve being configured to inhibit flow from the piston supply line to the first supply line when the first supply valve is OFF and the second supply valve is ON and the second check valve being configured to inhibit flow from the piston supply line to the second supply line when the second supply valve is OFF and the first supply valve is ON.

The supply assembly can provide water through a third supply line to a third outlet of the hydrant, and can further include a third supply valve adapted for coupling to the third supply line to supply water to the third supply line and a third check valve coupled to the first end of the piston supply line, the third check valve adapted to couple to the third supply line and being configured to inhibit flow from the piston supply line to the third supply line when the third supply valve is OFF and at least one of the first supply valve and the second supply valve is ON.

In one aspect of the invention, a valve assembly for use with first, second and third liquid lines can be provided and can include a body having a first surface and an opposite second surface and an outer peripheral surface extending between the first and second surfaces, the body being provided with spaced-apart first, second and third liquid bores extending through the first surface, the first, second and third liquid bores being adapted to respectively couple to the first, second and third liquid lines, the body having first, second and third valve bores extending through the peripheral surface to the respective first, second and third liquid bores, the first valve bore communicating with the first liquid bore at a first valve seat, the second valve bore communicating with the second liquid bore at a second valve seat, the third valve bore communicating with the third liquid bore at a third valve seat, a first part disposed in the first valve bore for sealably engaging with the first valve seat, a second part disposed in the second valve bore for sealably engaging with the second valve seat, and a third part disposed in the third valve bore for sealably engaging with the third valve seat.

The valve assembly can further include a connecting bore extending through the peripheral surface and communicating with each of the first, second and third valve bores. The valve assembly can further include a first closure device sealing the first valve bore at the peripheral surface and a second closure device sealing the second valve bore at the peripheral surface, wherein the third valve bore has an opening at the peripheral surface that serves as an outlet port for the valve assembly. The valve assembly can further include a limiting element disposed in the connecting bore and extending across each of the first, second and third valve bores for retaining the first, second and third parts within sealing proximity to the respective first, second and third valve seats. Each of the first and second surfaces can be planar and the peripheral surface can be circular. Each of the first, second and third parts can be circular. The first, second and third valve bores can be disposed in the same plane. The first, second and third valve bores can extend perpendicularly to the respective first, second and third liquid bores.

In one aspect of the invention a valve for use with a liquid can be provided and can include a housing having a chamber, the housing providing a first valve seat opening to the chamber and a second valve seat opening to the chamber, a part disposed in the chamber and movable between a first position sealably engaging the first valve seat for inhibiting flow through the first valve seat and a second position sealably the second valve seat for inhibiting flow through the second valve seat and a third position nonsealably disposed between the first and second valve seats.

The valve can further include a spring for urging the part away from the first valve seat, the spring being free of the part. The first valve seat can be opposite the second valve seat. The first valve seat can be disposed below the second valve seat. The part can be a ball. The part can be free in the chamber. The housing can be part of a hydrant.

In one aspect of the invention a valve for use with a liquid can be provided and can include a housing having first and second chambers and a passageway extending between a first opening in the first chamber and a second opening in the second chamber, the housing providing a first valve seat at the first opening and a second valve seat at the second opening, a first part disposed in the first chamber and movable between a closed position sealably engaging the first valve seat and an open position spaced from the first valve seat, a spring disposed in the housing for urging the first part away from the first valve seat to the second position, and a second part disposed in the second chamber and movable between a closed position sealably engaging the second valve seat and an open position spaced from the second valve seat.

The valve can further include a first limiting element carried by the housing for retaining the first part within sealing proximity to the first valve seat and a second limiting element carried by the housing for retaining the second part within sealing proximity to the second valve seat. Each of the first part and the second part ca be a ball. The first part can be free in the first chamber and the second part can be free in the second chamber. The housing can be part of a drain assembly for a hydrant.

I claim:

1. A valve assembly for use with first, second and third liquid lines, comprising a body having a first surface and an opposite second surface and an outer peripheral surface extending between the first and second surfaces, the body being provided with spaced-apart first, second and third liquid bores extending through the first surface, the first, second and third liquid bores being adapted to respectively couple to the first, second and third liquid lines, the body having first, second and third valve bores extending through the peripheral surface to the respective first, second and third liquid bores, the body being provided with a fluid passageway intersecting the first, second and third valve bores, a first valve seat being provided in the first valve bore between the fluid passageway and the first liquid bore, a second valve seat being provided in the second valve bore between the fluid passageway and the second liquid bore, a third valve seat being provided in the third valve bore between the fluid passageway and the third liquid bore, a first part disposed in the first valve bore for sealably engaging with the first valve seat to preclude fluid flow between the first valve bore and the first liquid bore, a second part disposed in the second valve bore for sealably engaging with the second valve seat to preclude fluid flow between the second valve bore and the second liquid bore, and a third part disposed in the third valve bore for sealably engaging with the third valve seat to preclude fluid flow between the third valve bore and the third liquid bore.

2. The valve assembly of claim 1, wherein the fluid passageway is a connecting bore extending through the peripheral surface and communicating with each of the first, second and third valve bores.

3. The valve assembly of claim 2, further comprising a first closure device sealing the first valve bore at the peripheral surface and a second closure device sealing the second valve bore at the peripheral surface, wherein the third valve bore has an opening at the peripheral surface that serves as an outlet port for the valve assembly.

4. The valve assembly of claim 2, further comprising a limiting element disposed in the connecting bore and extending across each of the first, second and third valve bores for retaining the first, second and third parts within sealing proximity to the respective first, second and third valve seats.

5. The valve assembly of claim 2, wherein the connecting bore is linear.

6. The valve assembly of claim 1, wherein the each of the first and second surfaces is planar and the peripheral surface is circular.

7. The valve assembly of claim 1, wherein each of the first, second and third parts is circular.

8. The valve assembly of claim 1, wherein the first, second and third valve bores are disposed in the same plane.

9. The valve assembly of claim 8, wherein the first, second and third valve bores extend perpendicularly to the respective first, second and third liquid bores.

10. A supply assembly for use in a hydrant to provide water through a first supply line to a first outlet of the hydrant and through a second supply line to a second outlet of the hydrant and through a third supply line to a third outlet of the hydrant, comprising a first supply valve adapted for coupling to the first supply line to supply water to the first supply line, a second supply valve adapted for coupling to the second supply line to supply water to the second supply line, a third supply valve adapted for coupling to the third supply line to supply water to the third supply line, a body having a first surface and an opposite second surface and an outer peripheral surface extending between the first and second surfaces, the body being provided with spaced-apart first, second and third liquid bores extending through the first surface and respectively coupled to the first, second and third supply valves, the body having first, second and third valve bores extending through the peripheral surface to the respective first, second and third liquid bores, the body being provided with a fluid passageway intersecting the first, second and third valve bores, a first valve seat being provided in the first valve bore between the fluid passageway and the first liquid bore, a second valve seat being provided in the second valve bore between the fluid passageway and the second liquid bore, a third valve seat being provided in the third valve bore between the fluid passageway and the third liquid bore, a first part disposed in the first valve bore for sealably engaging with the first valve seat and forming a first check valve to preclude fluid flow between the first valve bore and the first liquid bore, a second part disposed in the second valve bore for sealably engaging with the second valve seat and forming a second check valve to preclude fluid flow between the second valve bore and the second liquid bore, and a third part disposed in the third valve bore for sealably engaging with the third valve seat and forming a third check valve to preclude fluid flow between the third valve bore and the third liquid bore.

11. The supply assembly of claim 10, wherein the fluid passageway is a connecting bore extending through the peripheral surface and communicating with each of the first, second and third valve bores.

12. The supply assembly of claim 11, further comprising a first closure device sealing the first valve bore at the peripheral surface and a second closure device sealing the second valve bore at the peripheral surface, wherein the third valve bore has an opening at the peripheral surface that serves as an outlet port for the valve assembly.

13. The supply assembly of claim 11, further comprising a limiting element disposed in the connecting bore and extending across each of the first, second and third valve bores for retaining the first, second and third parts within sealing proximity to the respective first, second and third valve seats.

14. The supply assembly of claim 10, wherein the each of the first and second surfaces is planar and the peripheral surface is circular.

15. The supply assembly of claim 10, wherein each of the first, second and third parts is circular.

16. The supply assembly of claim 10, wherein the first, second and third valve bores are disposed in the same plane.

17. The supply assembly of claim 16, wherein the first, second and third valve bores extend perpendicularly to the respective first, second and third liquid bores.

18. The supply assembly of claim 10, further comprising a housing, the first supply valve, the second supply valve, the third supply valve and the body being disposed in the housing.

19. The supply assembly of claim 18, wherein the housing contains a first drain valve, a second drain valve and a third drain valve, the first supply valve coupled through the body to the first drain valve for permitting water to be drained from the first supply line when the first outlet is off, the second supply valve being coupled through the body to the second drain valve for permitting water to be drained from the second supply line when the second outlet is off and the third supply valve being coupled through the body to the third drain valve for permitting water to be drained from the third supply line when the third outlet is off.

20. The supply assembly of claim 19, further comprising a reservoir below the first drain valve, the second drain valve and the third drain valve for receiving water drained from the first supply line, the second supply line and the third supply line.

21. A supply assembly for use in a hydrant to provide water through a first supply line to a first outlet of the hydrant and through a second supply line to a second outlet of the hydrant and through a third supply line to a third outlet of the hydrant, comprising a first supply valve adapted for coupling to the first supply line to supply water to the first supply line, a second supply valve adapted for coupling to the second supply line to supply water to the second supply line, a third supply valve adapted for coupling to the third supply line to supply water to the third supply line, a body having a first surface and an opposite second surface and an outer peripheral surface extending between the first and second surfaces, the body being provided with spaced-apart first, second and third liquid bores extending through the first surface and respectively coupled to the first, second and third supply valves, the body having first, second and third valve bores extending through the peripheral surface to the respective first, second and third liquid bores, a first valve seat being provided in the first valve bore, a second valve seat being provided in the second valve bore, a third valve seat being provided in the third valve bore, a first part disposed in the first valve bore for sealably engaging with the first valve seat and forming a first check valve to preclude fluid flow between the first valve bore and the first liquid bore, a second part disposed in the second valve bore for sealably engaging with the second valve seat and forming a second check valve to preclude fluid flow between the second valve bore and the second liquid bore, a third part disposed in the third valve bore for sealably engaging with the third valve seat and forming a third check valve to preclude fluid flow between the third valve bore and the third liquid bore, the first supply valve being coupled through the body to a first drain valve for permitting water to be drained from the first supply line when the first outlet is off, the second supply valve being coupled through the body to a second drain valve for permitting water to be drained from the second supply line when the second outlet is off and the third supply valve being coupled through the body to a third drain valve for permitting water to be drained from the third supply line when the third outlet is off.

22. The supply assembly of claim 21, further comprising a housing, the first supply valve, the second supply valve, the third supply valve and the body being disposed in the housing.

23. The supply assembly of claim 21, further comprising a reservoir below the first drain valve, the second drain valve and the third drain valve for receiving water drained from the first supply line, the second supply line and the third supply line.

* * * * *